US005219495A

United States Patent [19]

Hsu

[11] Patent Number: 5,219,495

[45] Date of Patent: Jun. 15, 1993

[54] DETERGENT COMPOSITIONS CONTAINING MOBILE LIQUID ACTIVE SYSTEMS

[75] Inventor: Feng-Lung G. Hsu, Tenafly, N.J.

[73] Assignee: Lever Brothers Company, Division of Conopco, Inc., New York, N.Y.

[21] Appl. No.: 808,314

[22] Filed: Dec. 16, 1991

[51] Int. Cl.[5] ..... C11D 1/22; C11D 1/72; C11D 1/831; C11D 7/06

[52] U.S. Cl. ..... 252/559; 252/173; 252/174.13; 252/174.21; 252/174.25; 252/192; 252/539; 252/549; 252/550; 252/551; 252/552; 252/553; 252/554; 252/555; 252/556; 252/557; 252/558; 252/DIG. 4; 252/DIG. 14; 252/DIG. 1; 252/156

[58] Field of Search ..... 252/173, 174.13, 174.21, 252/174.25, 192, 539, 549, 550, 551, 552, 553, 554, 555, 556, 557, 558, 559, DIG. 4, DIG. 14, DIG. 1, 156

[56] References Cited

U.S. PATENT DOCUMENTS

| | | | |
|---|---|---|---|
| 3,970,595 | 7/1976 | Ginn et al. | 252/156 X |
| 4,661,281 | 4/1987 | Seiter et al. | 252/156 X |
| 4,923,636 | 5/1990 | Blackburn et al. | 252/550 |
| 5,045,238 | 9/1991 | Jolicoeur et al. | 252/550 |

FOREIGN PATENT DOCUMENTS

| | | | |
|---|---|---|---|
| 1467547 | 3/1977 | United Kingdom | 252/156 |

*Primary Examiner*—W. J. Shine
*Assistant Examiner*—Douglas J. McGinty
*Attorney, Agent, or Firm*—James J. Farrell

[57] ABSTRACT

A liquid detergent composition containing anionic detergent, nonionic detergent, excess caustic and high amounts of water is disclosed, together with processes for its preparation and use.

5 Claims, No Drawings

DETERGENT COMPOSITIONS CONTAINING MOBILE LIQUID ACTIVE SYSTEMS

BACKGROUND OF THE INVENTION

1. Field of the Invention

This invention relates to fluid mixtures of anionic and nonionic surfactants, and to processes for converting them into detergent powders.

2. The Related Art

Recent trends in the detergents market are towards denser fabric washing powders. The reasons for this are partly due to reduced packaging costs coupled with environmental considerations relating to less packaging materials. The majority of commercial detergent washing powders are presently manufactured by spray-drying processes which inherently tend to produce powders of relatively low bulk density, typically less than 500 g/liter. The bulk density of such powders is directly dependent on the amount and type of active detergent present in the powder during the spray-drying operation.

The commonly used anionic detergents, such as, sodium alkyl sulfates and sodium alkyl aryl sulfonates, are particularly prone to produce light powders by spray-drying methods.

Powders with higher bulk densities can be obtained if part of the active detergent is post-dosed onto the spray-dried powders rather than incorporated into the slurry before spray-drying. However, in order to be suitable for post dosing by spraying onto the powders, the active detergents (surfactants) must be sufficiently mobile to be atomized effectively at temperatures low enough to prevent degradation of the active, i.e., below about 90° C.

GB Patent No. 1 279 261 relates to processes for converting various liquid or liquefiable detergents principally nonionics into detergent powders by spraying those surfactants onto spray-dried builder beads. However, mixtures of aqueous anionic and nonionic surfactants are generally viscous gels which can only be oversprayed onto particulate absorbents if they are heated to a temperature, typically above 90° C., at which they become sufficiently mobile. This temperature in turn produces severe disadvantages in factory practice.

EP No. 88612A discloses mobile liquid detergents containing not more than 8% water and not less than 90% active detergent, including an anionic surfactant, a nonionic polyether, and coconut mono- or diethanolamide. Substantial quantities of the ethanolamide are required in order to obtain sufficiently mobile liquid products.

French Patent 2,645,876 discloses a combination of alkylbenzene sulfonate, nonionic and optionally ammonium quaternaries and water.

GB Patent No. 1,169,594 discloses liquid detergent compositions containing ammonium alkylbenzene sulfonate and a nonionic detergent. The compositions are prepared by passing ammonium through a mixture of alkylbenzene sulfonic acid and nonionic detergent.

U.S. Pat. Nos. 4,826,632 and 4,923,636 and European Patent 0,265,203 all disclose mobile liquid detergent compositions consisting essentially of up to 80% of selected anionic surfactant (sodium or potassium alkylbenzene sulfonate and/or alkyl sulfate), up to 80% selected nonionic surfactant and water in an amount not exceeding 10% by weight. These disclosed mixtures lose mobility as the water content increases over 10%.

U.S. Pat. No. 5,045,238 discloses a process for making high active alkyl sulfate paste and particles, nonionic may be included. In preparing these a slight excess of the stoichimetric amount of caustic NECESSARY to neutralize the alkyl sulfuric acid is employed up to a maximum of 1.5%. According to the patent, excess over this amount results in viscosity too high to pump easily.

An object of the present invention is to overcome one or more of the disadvantages of the art. Other objects will become apparent through the following summary, detailed discussion and examples.

SUMMARY OF THE INVENTION

It has now been discovered that a range of compositions containing anionic surfactant, nonionic surfactant and water in relatively high amounts up to about 35% may be prepared containing sodium or potassium hydroxide in excess of that necessary to neutralize the anionic sulfonic acid. These compositions are sufficiently mobile at temperatures no higher than about 90° C. to enable them to be conveniently atomized while still containing a large amount of water. The viscosity profile of these compositions is such that they can be easily applied by spraying on to particulate substrates.

According to the invention there is provided a liquid surfactant composition mobile at a temperature within the range of about 15° to 90° C. or if the anionic to nonionic ratio is appropriate and the type of nonionic is appropriate even down to about 5° C. This composition contains:

(a) a sodium or potassium salt of an alkylbenzene sulfonate or alkyl sulfate in an amount not exceeding 80% by weight and preferably 20 to 80% or even 20% to 60% by weight, (b) an ethoxylated nonionic surfactant in an amount not exceeding 80% by weight, preferably 20 to 80% and most preferably 20% to 60% by weight, (c) sodium or potassium hydroxide in an amount of about 2% to 15% by weight, depending on the ratio of anionic to nonionic. For very high anionic to nonionic ratios of 2:1 up to 4:1 a greater excess of caustic is preferred whereas for lower ratios of 0.125:1 smaller excess amounts such as 2% are sufficient.

(d) water in an amount of 0%–35% by weight preferably 5% to 20% by weight most preferably above 10% up to about 20% by weight.

The invention further provides a process for the manufacture of a particulate detergent composition or a component thereof, comprising contacting a solid particulate precursor material composed of detergent adjuncts at a temperature of about 15° C. to 90° C. with a mobile liquid surfactant composition comprising:

(a) a sodium or potassium salt of an alkylbenzene sulfonate or alkyl sulfate in an amount not exceeding 80% by weight and preferably 20 to 80% or even 20% to 60% by weight, (b) an ethoxylated nonionic surfactant in an amount not exceeding 80% by weight, preferably 20 to 80% and most preferably 20% to 60% by weight, (c) sodium or potassium hydroxide in an amount of 2% to 15% by weight, depending on the ratio of anionic to nonionic. For very high anionic to nonionic ratios of 2:1 up to 4:1 a greater excess of caustic is preferred whereas for lower ratios of 0.125:1 smaller excess amounts such as 2% are sufficient.

(d) water in an amount of 0%-35% by weight preferably 5% to 20% by weight and most preferably above 10% up to about 20% by weight.

DETAILED DESCRIPTION OF THE INVENTION

Higher water contents, that is, contents greater than about 10% when included in a composition of anionic and nonionic surfactants typically result in gel formation even with low ratios of anionic to nonionic such as 0.125:1. It has now been discovered that the addition of concentrated aqueous hydroxide solution (50 w/w %) unexpectedly prevents gel formation and reduces the viscosity of the composition even though water is added to the composition by the introduction of the aqueous hydroxide solution. The ability to increase the water content of such compositions greatly expands the operation window. The reduction of the viscosity facilitates the ease of operation by improving pumpability, spraying and the like.

Viscosity is extremely important since for ease of operation any composition must be capable of being sprayed at pressures commonly used such as 10 psi to 200 psi through nozzle sizes of about 0.1 mm to 3 mm at a temperatures of about room temperature of 20° C. up to about 90° C. Such low temperatures avoid excess evaporation. Typically, the viscosity of such solutions is about 50 centipoise to 5000 centipoise at a temperature of 60° or even somewhat higher.

Compositions having a ratio of anionic surfactant to nonionic surfactant of 0.125:1 to 4:1 may be employed but 1:1 to 3:1 are of especial interest.

The nonionic surfactant is preferably an ethoxylated or mixed ethoxylated-propoxylated primary or secondary aliphatic alcohol. Most preferred are ethoxylated primary alcohols, especially $C_8$-$C_{15}$ primary alcohols ethoxylated with from about 2 to 15 moles of ethylene oxide per mole of alcohol.

Examples of suitable nonionic surface-active compounds which may be used, include in particular the reaction products of alkylene oxides, usually ethylene oxide, with alkyl ($C_6$-$C_{22}$) phenols, generally 5-25 EO, i.e. 5-25 units of ethylene oxide per molecule; the condensation products of aliphatic ($C_8$-$C_{18}$) primary or secondary linear or branched alcohols with ethylene oxide, generally 2-30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides an dialkyl sulphoxides.

The anionic surfactant component in the composition of the invention may be a sodium or potassium salt of an alkyl or secondary alkyl or secondary alcohol sulfate, or, preferably, a sodium or potassium alkylbenzene sulfonate salt. Particularly suitable alkylbenzene sulfonates are sodium $C_{11}$-$C_{15}$ alkylbenzene sulfonates. Suitable alkyl sulfates are sodium $C_{11}$-$C_{15}$ alkyl sulfates, although other alkyl sulfates and sulfonates outside this carbon chain length range, and potassium alkyl sulfates and sulfonates may also be used.

The compositions and the methods of their preparation generally correspond to the liquid surfactant compositions described in the U.S. Pat. Nos. 4,826,632 and 4,923,636, hereby incorporated by reference herein, but in addition the compositions contain an excess of 2 to 15%, preferably 2-10% more preferably 2%-8%, to improve fluidity, by weight of a sodium or potassium hydroxide.

The liquid surfactant composition may be prepared as described in U.S. Pat. Nos. 4,826,632 and 4,923,636, with subsequent mixing of the excess concentrated aqueous caustic solution (50% w/w).

The mixtures of the invention, if sufficiently mobile at ambient temperature, are useful in their own right as concentrated liquid detergents. These may, for example, be used as such or in diluted form as dishwashing liquids.

The method of preparation of the liquid mixture of the invention is important. Simple admixture of normally 50% aqueous neutralized alkylbenzene sulphonate paste and liquid nonionic surfactant in the desired proportions will give not a mobile isotropic liquid but rather result in a highly viscous gel which is not very pumpable and is difficult to handle and to atomize. Excess caustic added to the gel will reverse the gel.

It is preferred to mix the nonionic surfactant with the concentrated aqueous hydroxide solution (50% w/w). The amount of hydroxide used is stoichiometric to the alkylbenzene sulfonic acid to be used plus the desired excess quantity, the alkylbenzene sulfonic acid is then mixed with the nonionic/hydroxide mixture.

In a batch method or in a continuous method the anionic surfactant acid, the nonionic surfactant and the caustic may be introduced substantially simultaneously or the anionic surfactant acid may be in a partially or wholly neutralized form.

The liquid surfactant composition thus obtained may then be used to contact a solid particulate material. According to the present invention, the solid material may be a detergent builder or a spray-dried detergent material.

The invention is primarily concerned, however, with the preparation of granular detergent products by spraying the liquid mixtures of the invention onto granular base materials. For this proposed use the compositions of the invention should be sufficiently mobile at a temperature within the range of from 15° to 90° C. to be sprayable.

The process of the invention is highly suitable for the manufacture of detergent powders of high bulk density, for example, the solid particulate absorbent material may have a bulk density of at least 300 g/liter, preferably at least 500 g/liter, and the value after spray-on will be even higher because the spraying-on operation will generally lead to an increase in bulk density. The usefulness of the process of the invention is not, however, limited to very dense products: the process may be used to produce products over the whole range of densities.

A number of possible solid absorbent base materials may be used. One which has many advantages is spray-dried detergent base powder, that is the powder which is conventionally produced by spray-drying an aqueous slurry comprising detergency builder, sodium silicate (usually), and other more minor components in a spray-drying tower. It is permissible to incorporate some surfactant into the slurry to be spray-dried without seriously decreasing the density of the material or its absorbency. Amounts of up to 2% by weight of anionic surfactant or up to 5% by weight of nonionic surfactant in the slurry can usually be tolerated.

In an alternative approach, the surfactant mixture of the invention may be sprayed onto an inorganic carrier material which is subsequently dry-mixed with other necessary or desirable components of the final composition. The inorganic carrier material may itself be spray-dried: examples of suitable absorbent spray-dried inorganic carrier materials are sodium carbonate/sodium bicarbonate mixtures as described and claimed in GB 1,595,769; sodium carbonate/sodium silicate mixtures as described in GB 1,595,770; and, of especial interest, crystal-growth-modified sodium carbonate monohydrate and crystal-growth-modified Burkeite (sodium carbonate/sodium sulphate) as described in EP 221,776.

Crystal-growth-modified sodium carbonate monohydrate and Burkeite may be prepared by spray drying an aqueous slurry comprising sodium carbonate, and optionally also comprising sodium sulphate in a weight ratio of sodium carbonate to sodium sulphate of at least 0.03:1, the total amount of sodium carbonate and (if present) sodium sulphate being at least 10% by weight based on the dried powder; an effective amount of a crystal growth modifier which is an organic material having at least three carboxyl groups in the molecule; and optionally one or more anionic and/or nonionic detergent-active compounds, one or more detergency builders and/or one or more further heat-insensitive detergent components; the crystal growth modifier being incorporated in the slurry not later than the sodium carbonate; whereby crystal growth-modified sodium carbonate monohydrate and/or crystal-growth-modified Burkeite is or are formed in the slurry.

In general, the use of spray-dried particulate absorbent materials is appropriate for the manufacture of detergent powders with a range of bulk densities from low (300 g/l) to quite high (850 g/l) or even higher.

In addition to the materials already referred to as necessarily being present because of the nature of the invention, a large number of other materials may be present in the compositions produced by the process of the invention. Although some of the particulate absorbent materials referred to above can be materials which also have a detergency building action, it is also possible to add detergency builders to the compositions, by including them in any crutcher slurry which is produced and spray-dried, or by adding them to the composition produced by the spray-drying step. Examples of such detergency builders are sodium tripoly-, pyro- and orthophosphates, sodium aluminosilicates including zeolites, sodium carbonates, sodium citrate and various organic detergency builders such as sodium nitrilotriacetate. Generally, detergency builders will be present in amounts of from 15 to 50% by weight of the final product, amounts of from 25 to 40% by weight being more general.

Detergent powders according to the invention may contain other conventional ingredients added either via the slurry (if the absorbent is a spray-dried powder) or by simple mixing in accordance with their known properties. Such ingredients include enzymes, fluorescers, antiredeposition agents, bleaches, bleach activators, bleach stabilizers, lather suppressors, dyes and perfumes.

The invention is further illustrated by the following non-limiting Examples, in which parts and percentages are by weight unless otherwise indicated.

In the Examples which follow, the following abbreviations are used:

LAS: Sodium salt of $C_{11}$–$C_{15}$ alkylbenzene sulfonic acid (Stepan trademark Bio-Soft S-100)

NI: Nonionic surfactant ($C_{12}$–$C_{15}$ alcohol ethoxylates), Shell trademark Neodol 25-7

N13EO: Nonionic surfactant ($C_{12}$–$C_{14}$ alcohol ethoxylates), Hoechst Celanese, trademark Genapol 24L98N L: liquid phase G: gel formation

EXAMPLES 1-6

The neutralized mobile liquid surfactant mixture listed in Example 1 was prepared by mixing the nonionic surfactant with the indicated amount of concentrated aqueous sodium hydroxide solution (50 w/w %) and subsequently mixing with alkylbenzene sulfonic acid, Stepan Bio-Soft S-100. Addition of extra water resulted in gel formation as shown in Example 2. However, the addition of extra NaOH solution reversed the gel phase into the liquid phase as demonstrated in Example 3 despite having a higher water content than Example 2. Examples 4-6 show the same trend that a higher NaOH content is needed to maintain the liquid state for a higher level of water present in the composition. The percentages reported in the following Table are based on the final total content of materials.

| | Example | | | | | |
|---|---|---|---|---|---|---|
| | 1 | 2 | 3 | 4 | 5 | 6 |
| | (% by weight) | | | | | |
| LAS | 43.0 | 36.7 | 35.3 | 33.0 | 27.5 | 23.8 |
| NI | 43.6 | 37.1 | 35.8 | 33.4 | 27.8 | 24.1 |
| Water | 10.4 | 23.6 | 24.6 | 29.6 | 33.0 | 42.0 |
| NaOH (100%) Excess | 3.0 | 2.6 | 4.3 | 4.0 | 11.7 | 10.1 |
| Phase* | L | G | L | G | L | G |

*at room temperature

EXAMPLES 7-10

The following liquid surfactant mixtures were prepared by mixing the nonionic surfactant with concentrated aqueous sodium hydroxide solution (50 w/w %) in an amount stoichiometric to the alylbenzene sulfonic acid plus the excess quantity of NaOH solution. This mixture was then mixed with the alkylbenzene sulfonic acid. The viscosity was measured by a Contraves Rheomat model 108E at room temperature. Examples 7-10 demonstrate the effect of the excess of sodium hydroxide in reducing the viscosity of the surfactant compositions.

| | Example | | | |
|---|---|---|---|---|
| | 7 | 8 | 9 | 10 |
| | (% by weight) | | | |
| LAS | 60.0 | 57.1 | 54.5 | 52.1 |
| NI | 29.8 | 28.4 | 27.1 | 25.9 |
| Water | 10.2 | 12.1 | 13.8 | 15.4 |
| NaOH (100%) Excess | 0.0 | 2.4 | 4.6 | 6.6 |
| Shear Rate, 1/sec | 9.85 | 9.85 | 9.85 | 9.85 |
| viscosity, cp | too high to measure | 4120 | 532 | 537 |

EXAMPLE 11

An aqueous slurry was spray-dried to form a particulate precursor having the following composition:

| | |
|---|---|
| Zeolite | 53.19 |
| $Na_2CO_3$ | 29.55 |
| Na-Citrate | 4.93 |
| Na-Sulfate | 1.97 |

-continued

| | |
|---|---|
| N13EO | 1.97 |
| water | 8.00 |
| minor | 0.39 |

Subsequently, 25.8 parts of the liquid surfactant mixture was prepared according to this invention. The mixture was composed of 60% LAS, 27.4% of Neodol 25-7 nonionic surfactant, 1.3% excess NaOH (100% active) and 11.3% water, and was sprayed at about 80° C. onto 56.8 parts of the particulate precursor to form an adjunct. The adjunct was further processed by layering 5.2 parts of zeolite and post dosing 12.2 part of $Na_2CO_3$. The finished detergent powder has a bulk density of 726 g/liter with good powder properties.

EXAMPLE 12

1:1 LAS: NI (approximate) compositions were prepared and observed at room temperature. The results are as follows:

| | | | | | | | |
|---|---|---|---|---|---|---|---|
| LAS 1/NI 1 | 90% | 87% | 74% | 72% | 67% | 56% | 48% |
| NaOH Excess (100% active basis) | 0% | 2% | 2% | 4% | 3% | 11% | 10% |
| WATER | 10% | 11% | 24% | 25% | 30% | 33% | 42% |
| Phase* | L | L | G | L | G | L | G |

*at room temperature:
I: liquid: G: Gel formation

EXAMPLE 13

3:1 LAS: LI compositions were prepared and observed at 180° F. as follows:

| | A. | B. |
|---|---|---|
| LAS | 66.5% | 60.1% |
| NI | 22.1% | 20.0% |
| NaOH Excess (100% active basis) | 0.4% | 5.1% |
| Water | 11.0% | 14.8% |

-continued

| | A. | B. |
|---|---|---|
| Phase | Gel | Liquid |

The composition was prepared by mixing the caustic with the nonionic and then adding the sulfonic acid. It can be seen in B that for very similar compositions the excess caustic results in a liquid.

It is understood that the examples and embodiments described herein are for illustrative purposes only and that various modifications or changes in the light thereof will be suggested to persons skilled in the art and are to be included within the spirit and purview of this application and the scope of the appended claims.

What is claimed is:

1. A liquid surfactant composition mobile at a temperature within the range of about 15° to 90° C. consisting essentially of:

(a) An anionic sodium or potassium salt of an alkylbenzene sulfonic acid or alkyl sulfuric acid in an amount of about 20% to 80% by weight;

(b) an ethoxylated nonionic surfactant in an amount of about 20% to 80% by weight;

(c) sodium or potassium hydroxide in an amount in excess of that necessary to stoichiometrically neutralize said alkyl sulfuric acid or alkylbenzene sulfonic acid; and (d) the balance consisting essentially from above 10% of up to about 35% water by weight;

said composition having a ratio of the anionic surfactant to the nonionic surfactant of 0.125:1 to 4:1;

the excess of hydroxide being about 2% to 15% by weight.

2. A composition according to claim 1 said anionic to nonionic ratio being 2:1 and said excess amount of sodium or potassium hydroxide being about 4% to 6% by weight.

3. A composition according to claim 1, comprising an excess of 2% to 10% by weight of the sodium or potassium hydroxide.

4. A composition according to claim 1 said anionic to nonionic ratio being 1:1 to about 3:1.

5. A composition according to claim 1 said anionic to nonionic ratio being 2:1.

* * * * *